US007512352B2

(12) United States Patent
Kimura et al.

(10) Patent No.: US 7,512,352 B2
(45) **Date of Patent: *Mar. 31, 2009**

(54) IMAGE FORMING APPARATUS WITH SWITCHED-POTENTIAL RESPONSIVE TO ATTENUATION OF A REMAINING VOLTAGE

(75) Inventors: Kuniyasu Kimura, Toride (JP); Eiichi Motoyama, Shinjuku-ku (JP); Yoshihito Osari, Chuo-ku (JP); Hiroaki Tomiyasu, Toride (JP); Takahiko Yamaoka, Kashiwa (JP); Yuichi Yamamoto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/034,787

(22) Filed: Feb. 21, 2008

(65) Prior Publication Data

US 2008/0152372 A1 Jun. 26, 2008

Related U.S. Application Data

(62) Division of application No. 11/740,486, filed on Apr. 26, 2007, now Pat. No. 7,356,273, which is a division of application No. 11/138,383, filed on May 27, 2005, now Pat. No. 7,333,742.

(30) Foreign Application Priority Data

Jun. 4, 2004 (JP) ..... 2004-167708

(51) Int. Cl.
*G03G 15/06* (2006.01)
*G03G 15/08* (2006.01)

(52) U.S. Cl. ..... 399/55; 399/285

(58) Field of Classification Search ..... 399/38, 399/51, 53, 55, 98, 270, 285
See application file for complete search history.

(56) References Cited

U.S. PATENT DOCUMENTS 5,652,953 A 7/1997 Imai
6,128,449 A 10/2000 Zenba et al.
6,466,244 B2 10/2002 Itoh (Continued)

FOREIGN PATENT DOCUMENTS

JP 62-49375 A 3/1987

(Continued)

OTHER PUBLICATIONS

Japanese Notification of Reason for Refusal dated Oct. 14, 2008 in Japanese Application No. 2004-167708, and an English-language translation thereof.

*Primary Examiner*—Sandra L Brase
(74) *Attorney, Agent, or Firm*—Fitzpatrick, Cella, Harper & Scinto

(57) ABSTRACT

An image forming apparatus changes over an electric potential on an image bearing member in response to an attenuation region in which a remaining potential on a developing member is attenuating after a developing bias applied to the developing member has been turned off after completion of an image forming operations. Accordingly, it is possible to mitigate adherence of developer due to a large potential difference between the developing member and the image bearing member.

3 Claims, 15 Drawing Sheets

U.S. PATENT DOCUMENTS

| | | | | |
|---|---|---|---|---|
| 6,507,718 | B2 | 1/2003 | Ohjimi et al. | |
| 6,556,229 | B2 | 4/2003 | Mitsuya et al. | |
| 6,647,219 | B2 | 11/2003 | Buettner | |
| 6,845,222 | B2 | 1/2005 | Takai | |
| 6,973,275 | B2 | 12/2005 | Sasai | |
| 7,356,273 | B2 * | 4/2008 | Kimura et al. | 399/55 |

FOREIGN PATENT DOCUMENTS

| | | | |
|---|---|---|---|
| JP | 5-333687 | A | 12/1993 |
| JP | 7-253693 | | 10/1995 |
| JP | 8-36342 | A | 2/1996 |
| JP | 9-281611 | A | 10/1997 |
| JP | 2000-3114 | A | 1/2000 |

* cited by examiner

FIG. 7

| DEVELOPING BIAS | POSTEXPOSURE TABLE NO. |
|---|---|
| NOT MORE THAN −350 [V] | a |
| −350 [V] TO −460 [V] | b |
| NOT LESS THAN −460 [V] | c |

(a)

| TIME FROM START OF POSTEXPOSURE [ms] | LASER POWER |
|---|---|
| 0 | 0 |
| 10 | 8 |
| 30 | 11 |
| 50 | 13 |
| 80 | 15 |

(b)

| TIME FROM START OF POSTEXPOSURE [ms] | LASER POWER |
|---|---|
| 0 | 0 |
| 10 | 6 |
| 30 | 9 |
| 50 | 11 |
| 70 | 13 |
| 100 | 15 |

(c)

| TIME FROM START OF POSTEXPOSURE [ms] | LASER POWER |
|---|---|
| 0 | 0 |
| 10 | 5 |
| 20 | 6 |
| 30 | 8 |
| 50 | 10 |
| 70 | 12 |
| 100 | 15 |

FIG. 9

| DURABLE TIME OF PHOTOSENSITIVE DRUM (NUMBER OF RECORDING MEMBERS) | DEVELOPING BIAS [V] |
|---|---|
| 0 | −480 |
| 1000 | −460 |
| 3000 | −430 |
| 5000 | −410 |
| 10000 | −380 |
| 15000 | −350 |
| 30000～ | −330 |

FIG. 11

| TIME FROM CEASE OF DEVELOPING BIAS [ms] | DEVELOPING BIAS [V] | DIFFERENCE FROM DRUM SURFACE POTENTIAL [V] | LASER POWER |
|---|---|---|---|
| 0 | −450 | 150 | 0 |
| 10 | −282 | 318 | 8 |
| 20 | −198 | 402 | 11 |
| 30 | −153 | 447 | 12 |
| 40 | −120 | 480 | 12 |
| 50 | −93 | 507 | 13 |
| 60 | −74 | 526 | 14 |
| 70 | −55 | 545 | 14 |
| 80 | −40 | 560 | 14 |
| 90 | −23 | 577 | 15 |
| 100 | −10 | 590 | 15 |
| 110 | 0 | 600 | 15 |

IMAGE FORMING APPARATUS WITH SWITCHED-POTENTIAL RESPONSIVE TO ATTENUATION OF A REMAINING VOLTAGE

CROSS REFERENCE RELATED APPLICATIONS

This application is a divisional of application Ser. No. 11/740,486, filed Apr. 26, 2007, now U.S. Pat. No. 7,356,273, issued Apr. 8, 2008, which is a divisional of application Ser. No. 11/138,383, filed May 27, 2005, now U.S. Pat. No. 7,333, 742, issued Feb. 19, 2008.

BACKGROUND OF THE INVENTION

1. Field of the Invention

The present invention relates to an image forming apparatus employing an electrophotographic system, such as a printer, copying machine, facsimile and the like.

2. Description of the Related Art

FIG. 13 shows an image forming unit (image producing unit) in a prior art image forming apparatus using the electrophotographic system. The image forming unit comprises a photosensitive drum (image bearing member) 101 having a photosensitive surface layer and being rotatable in a direction shown by an arrow R101, an electricity removing device 102 for removing an electric charge remaining on the photosensitive drum 101 to set a surface charge of the drum to a predetermined uniform charge, a charging unit 103 for uniformly charging the photosensitive drum 101, an optical device 104 for exposing the photosensitive drum 101 to form electrostatic latent images thereon, a developing device 105 for developing the electrostatic latent image, a transferring unit 106 for transferring a toner image on the photosensitive drum 101 to a recording material P or an intermediate transferring body, for example, an intermediate transferring belt, or an intermediate transferring drum, a cleaning device 107 having cleaning blades for removing toner remaining on the photosensitive drum 101 after transferring the toner image, and the like.

The developing device 105 is filled with a two-component developer consisting of a carrier of magnetic powder and toner which is nonmagnetic or weaker in magnetic property than the carrier, the carrier and toner being mixed with each other with a predetermined ratio. A constant developing bias is applied to a sleeve of the developing device 105 which is bearing the toner and carrier to give a predetermined electric charge to the toner. The charged toner is transferred by rotation of a developing sleeve to cause the toner to be deposited onto an electrostatic latent image formed on the photosensitive drum 101, thereby developing the latent image to a toner image.

In processing after completion of an image forming operation, the developing bias of the developing device 105 must be turned off in timing with the removal of the electric charge from the photosensitive drum 101 by the electricity removing device 102. As shown in FIG. 14(*a*), if the developing bias of the developing device 105 is turned off prior to lowering of the surface electric potential of the photosensitive drum 101 (drum surface electric potential) by the electricity removing device 102, the carrier in the developing device 105 will adhere to the surface of the photosensitive drum 101 because of the potential difference between the surface of the photosensitive drum 101 and the sleeve of developing device 105. As shown in FIG. 14(*b*), reversely, in a case that the surface potential of the photosensitive drum 101 is lowered prior to the lowering of the potential in the developing device 105, the potential difference between the surface of the photosensitive drum 101 and the sleeve of the developing device 105 becomes the same state as that when normally forming images, with the result that the toner will adhere to the surface of the photosensitive drum 101.

In the case that the toner adheres to the surface of the photosensitive drum 101, although it is a slight amount, toner is uselessly consumed at each end of printing (image forming). Because stoppage of the rotation of the photosensitive drum 101 with the toner remaining thereon is unfavorable, it is required to continue the rotation of the photosensitive drum 101 until the toner remaining on the photosensitive drum 101 has been removed therefrom by the cleaning device 107. On the other hand, when the carrier adheres to the surface of the photosensitive drum 101, there is a risk of the surface of the photosensitive drum being damaged by the carrier in addition to the useless consumption of the carrier. Therefore, such a state should be avoided to the extent possible. According to the prior art as shown in FIG. 14 when the electric potential of the photosensitive drum converges at a lower rate, the timing for removing the electric charge on the photosensitive drum 101 and the timing for turning off the developing bias of the developing device 105 are so determined that the amounts of the carrier and toner adhering to the photosensitive drum 101 are minimized. Moreover, when the potential of the photosensitive drum converges at a faster rate, the timing is so set that the amounts of the carrier and toner adhering to the photosensitive drum become small as shown in FIG. 14(*d*). In such a case, however, when the rate of convergence varies depending upon the conditions of image forming operations, the contrast of the photosensitive drum potential and developing bias becomes unstable so that the carrier and toner may frequently adhere to the drum. In the case of a lower converging rate of the potential, the contrast of the surface potential and the developing bias becomes partly greater only by taking measures that the surface potential is further lowered and the timing of turning off is shifted, as disclosed in Japanese Patent Application Laid-Open No. 333,687/1993, so that the problems described above would occur. By constructing the device such that attenuation curves of the potential (G) of the photosensitive drum and the developing bias (F) to be applied to the sleeve are caused to be coincident with each other to the extent possible as shown in FIG. 15 and as disclosed in Japanese Patent Application Laid-Open No. 49,375/1987, it may be possible to avoid extreme enlargement of the contrast of the potential of the photosensitive drum and the developing bias, even if the converging rate varies depending upon conditions of image forming operations.

However, using the approach causing the attenuation curve of potential or voltage to be coincident with the attenuation curve of other potential or voltage, the following problems occur. Namely, in the case of curvilinearly varying the potential or voltage to be brought into coincidence, the resolution of the part at which potential or the like is switched over must be elevated. For this purpose, electric circuits must be constructed with higher accuracy and must be complicated for timing sequence. The same effects can be obtained by switching the potential or voltage in a plurality of steps within the range in which no adherence of the carrier and toner occurs without curved attenuating characteristics of potential or voltage.

SUMMARY OF THE INVENTION

The present invention is capable of mitigating with a simple structure the adherence of developer to image bearing member that is caused by attenuating and lowering electrical contributing factors.

Another object of the invention is to provide an image forming apparatus comprising: an image bearing member, charging means for charging the image bearing member, electrostatic latent image forming means for forming an electrostatic latent image on the image bearing member charged by the charging means, developing member for forming a visible image on the basis of the electrostatic latent image formed on the image bearing member by applying voltage to the developing member, voltage applying means for applying voltage to the developing member, wherein a remaining voltage on the developing member has an attenuation region in which the remaining voltage attenuates after a supply of the voltage from the voltage applying means to the developing member is turned off, and electric potential controlling means for switching the electric potential on the image bearing member in a plurality of steps before being developed in response to an attenuation state of the attenuation region.

Further objects of the invention will become apparent from the following description.

BRIEF DESCRIPTION OF THE DRAWINGS

FIG. 7 are tables for selecting a laser power setting table when removing the charge;

FIG. 9 is a table showing the relation between durable time of the photosensitive drum and developing bias;

FIG. 11 is a laser power setting table automatically produced;

DESCRIPTION OF THE EMBODIMENTS

Figure 1:
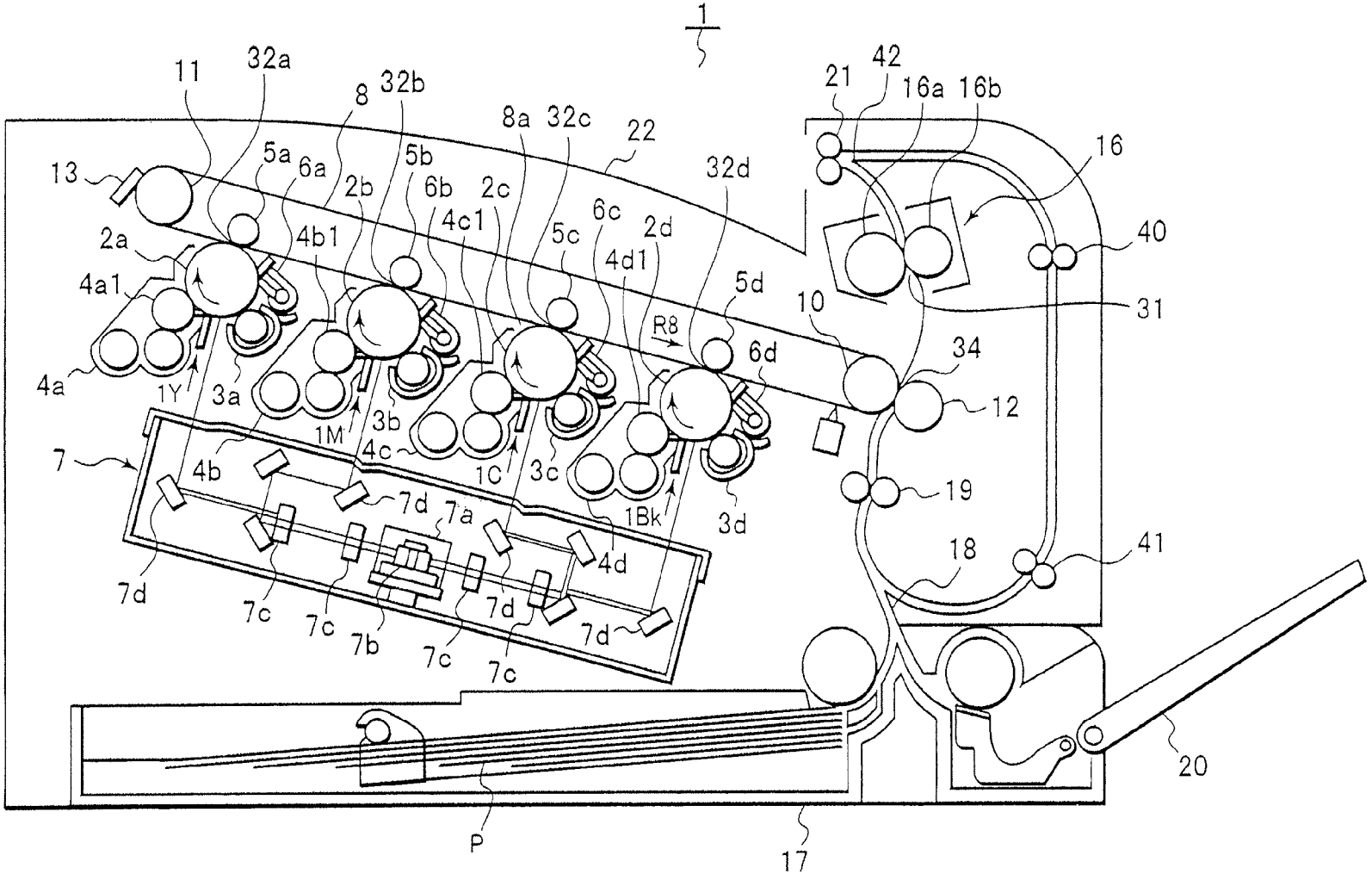
FIG. 1 is a front longitudinal sectional view illustrating schematic construction of an image forming apparatus to which the present invention is applicable.

Embodiments of the present invention will now be explained with reference to the drawings. Components identified by identical reference numerals in the respective drawings are the same in structure and function, and redundant explanations for these components will generally be omitted.

Embodiment 1

FIG. 1 is a longitudinal sectional view, which illustrates one example of the image forming apparatus to which the present invention is applicable. In FIG. 1, the image forming apparatus 1 is a printer of a four, full-color electrophotographic system (referred to hereinafter as an "image forming apparatus").

The image forming apparatus 1 comprises four image forming units (for four colors) as image forming sections, that is, image forming units 1Y, 1M, 1C and 1Bk for forming image (toner images) of yellow (Y), magenta (M), cyan (C) and black (Bk). These four image forming units 1Y, 1M, 1C and 1Bk are arranged in the named order in a row with a predetermined interval from upstream to downstream along a moving direction (rotational direction) of an intermediate transferring belt 8 as an intermediate transferring body.

Each of the image forming units 1Y, 1M, 1C and 1Bk each comprises an electrophotographic sensitive body 2*a*, 2*b*, 2*c* and 2*d* in the form of a drum as a respective image bearing member (referred to hereinafter as a "photosensitive drum") arranged rotatably in the direction shown by an arrow. Around each of the photosensitive drums 2*a*, 2*b*, 2*c* and 2*d* there are provided a primary charging unit 3*a*, 3*b*, 3*c* and 3*d* as charging means, a developing device 4*a*, 4*b*, 4*c* and 4*d* as developing means, a transferring roller 5*a*, 5*b*, 5*c* and 5*d* as transferring means, and a cleaning device 6*a*, 6*b*, 6*c* and 6*d* as cleaning means in the named order along the rotating direction of the respective photosensitive drum. Under the image forming units 1Y, 1M, 1C and 1Bk, there is provided an exposure device 7 as an electrostatic latent image forming means for forming electrostatic latent images by exposure.

Negatively-charged OPC photosensitive bodies (organic photosensitive bodies) may be used as the photosensitive drums 2*a*, 2*b*, 2*c* and 2*d*. Each of the photosensitive drums 2*a*, 2*b*, 2*c* and 2*d* has an OPC photosensitive layer as a photoconductive layer on the surface (outer circumferential surface) of a base drum made of aluminum. Each of the drums is driven at a predetermined processing speed in a direction shown by an arrow by driving means (not shown).

Each of the primary charging units 3*a*, 3*b*, 3*c* and 3*d* causes the surface of the photosensitive drums 2*a*, 2*b*, 2*c* and 2*d* to be uniformly charged to have a predetermined potential of negative polarity by a charge bias applied from a charge bias applying power source (not shown). Although the charging rollers are used as charging members in the illustrated embodiment, other charging members, such as charging brushes and the like, may be used without any objection.

The exposure device 7 as electrostatic latent image forming means comprises laser emitting means 7*a* for light emission corresponding to a time series, electric digital picture element signals of given image information, a polygon mirror 7*b*, lenses 7*c*, reflecting mirrors 7*d* and the like. The surfaces of the photosensitive drums 2*a*, 2*b*, 2*c* and 2*d* which have been charged by the respective primary charging units 3*a*, 3*b*, 3*c* and 3*d* are exposed by the exposure device 7 to form electrostatic latent images of respective colors corresponding to the image information on the surfaces of the respective photosensitive drums 2*a*, 2*b*, 2*c* and 2*d*. In the illustrated embodiment, the laser emitting means 7*a* is so constructed that laser power can be changed in fifteen stages by changing over the output current of laser.

Each of the developing devices 4*a*, 4*b*, 4*c* and 4*d* has toner of respective colors of yellow, magenta, cyan and black accommodated therein. Each of the developing sleeves 4*a*1, 4*b*1, 4*c*1 and 4*d*1 as developing members causes toner of a respective color to adhere onto the electrostatic latent image formed on the photosensitive drums 2*a*, 2*b*, 2*c* and 2*d* to develop these latent images to toner images (making the images to visible).

The transferring rollers 5*a*, 5*b*, 5*c* and 5*d* as transferring members are each arranged so as to be able to abut against the photosensitive drums 2*a*, 2*b*, 2*c* and 2*d*through an intermediate transferring belt 8 at a primary transferring portion 32*a*, 32*b*, 32*c* and 32*d*.

Each of the cleaning devices 6*a*, 6*b*, 6*c* and 6*d* has cleaning blades and the like for removing from the photosensitive drums 2*a*, 2*b*, 2*c* and 2*d* the toner (remaining toner in the primary transferring) which has not been transcribed onto the intermediate transferring belt 8, and which remains on the photosensitive drums 2*a*, 2*b*, 2*c* and 2*d*.

The intermediate transferring belt 8 is arranged on the upper side of the respective photosensitive drums 2*a*, 2*b*, 2*c* and 2*d* and extends under tension around and between a secondary transferring opposite roller 10 and a tension roller 11. The secondary transferring opposite roller 10 is arranged so as to be able to abut against a secondary transferring roller 12 through the intermediate transferring belt 8 at the secondary transferring portion 34. The intermediate transferring belt 8 is formed in an endless shape from a dielectric resin, such as polycarbonate, polyethylene terephthalate, polyvinylidene chloride film and other resin films.

The intermediate transferring belt 8 is arranged in an inclined position in a manner that its primary transferring surface 8*a* facing to the photosensitive drums 2*a*, 2*b*, 2*c* and 2*d* is positioned with one end on the side of the secondary transferring roller 12 being lower than the other end.

In other words, the intermediate transferring belt 8 is obliquely arranged so that its primary transferring surface 8*a*, or lower surface, is arranged to be movable on and facing to the upper surfaces of the photosensitive drums 2*a*, 2*b*, 2*c* and 2*d* and formed on the side of the opposite surface of the drums 2*a*, 2*b*, 2*c* and 2*d* and is inclined with the one end on the side of the secondary transferring portion 34 being lower than the other end. In fact, its inclined angle is set at approximately 15°. Moreover, the intermediate transferring belt 8 extends under tension between the secondary transferring opposite roller 10 arranged on the side of the secondary transferring portion 34 and providing a driving force to the intermediate transferring belt 8 and the tension roller 11 arranged on the opposite side of the secondary transferring portion 34 with respect to the primary transferring portions 32*a*, 32*b*, 32*c* and 32*d*, providing a tensile force to the intermediate transferring belt 8.

The secondary transferring opposite roller 10 is arranged to abut against the secondary transferring roller 12 through the intermediate transferring belt 8 at the secondary transferring portion 34. In the proximity of the tension roller 11 and outside the endless intermediate transferring belt 8, a belt cleaning device 13 is arranged for removing and recovering the toner remaining on the intermediate transferring belt 8. A fixing device 16 having a fixing roller 16*a* and a pressure roller 16*b* is arranged downstream of secondary transferring portion 34 with respect to the transferring direction of recording materials in a manner forming a longitudinal pass.

The image forming operations using the image forming apparatus 1 constructed as described above will now be explained.

When a signal for starting the image forming operations is output, the respective photosensitive drums 2*a*, 2*b*, 2*c* and 2*d*, rotationally driven at predetermined processing speeds, of the image forming units 1Y, 1M, 1C and 1Bk are equally charged with a negative polarity by the primary charging units 3*a*, 3*b*, 3*c* and 3*d*. The exposure device 7 irradiates image signals from the laser emitting element, which image signals have been input from the outside of the device and resolved in colors. The irradiated image signals are directed by the polygon mirror, lenses, and reflecting mirrors to form electrostatic latent images of the respective colors on the photosensitive drums 2*a*, 2*b*, 2*c* and 2*d*.

Then, first, yellow toner is caused to adhere onto the electrostatic latent images formed on the photosensitive drum 2*a* by the developing sleeve 4*a*1 as a developing member to which developing bias of the same polarity as that (negative polarity) of the photosensitive drum 2*a* has been applied, thereby making the electrostatic latent images visible as toner images. These yellow toner images are primarily transcribed on the intermediate transferring belt 8 being driven, at the primary transferring portion 32*a* between the photosensitive drum 2*a* and the transferring roller 5*a* by the transferring roller 5*a* to which primary transferring bias (in positive polarity which is reverse to that of the toner) has been applied.

At that time, the toner remaining on the photosensitive drum 2*a* without being transcribed to the intermediate transferring belt 8 is scraped from the drum by the cleaning blades of the cleaning device 6*a* for recovery.

The intermediate transferring belt 8 having the yellow toner images transcribed thereon is moved to the image forming unit 1M. In a similar manner to the image forming unit 1Y, in the image forming unit 1M, magenta toner images are formed on the photosensitive drum 2*b* and are superposed on the yellow toner images on the intermediate transferring belt 8 to be transcribed at the primary transferring portion 32*b*. Moreover, the toner remaining on the photosensitive drum 2*b* is removed by the cleaning blades of the cleaning device 6*b*.

In a similar manner hereafter, cyan toner images and black toner images formed on the photosensitive drums 2*c* and 2*d* of the image forming unit 1C and 1Bk, respectively, are sequentially superposed on the yellow and magenta toner images doubly transcribed on the intermediate transferring belt 8 at the primary transferring portions 32*c* and 32*d*, respectively, thereby superposing the four color toner images on the intermediate transferring belt 8.

In timing with movement of the leading end of the four color toner images on the intermediate transferring belt 8 to the secondary transferring portion 34 between the secondary transferring opposite roller 10 and the secondary transferring roller 12, a recording material (paper) P selected and supplied through a transferring pass 18 from a paper supplying cassette 17 or manual paper supply tray 20 is transferred to the secondary transferring portion 34 by resist rollers 19. The four color toner images are secondarily transcribed on the recording material P in its entirety by the secondary transferring roller 12 to which secondary transferring bias (positive polarity which is reverse to that of the toner) has been applied.

The recording material P having the four color toner images transcribed thereon is transferred to the fixing device 16 where the four color toner images are heated and pressed at the fixing nip portion 31 between the fixing roller 16*a* and the pressure roller 16*b* so as to be fixed to the surface of the recording material by thermal fixing. The recording material P having the four color toner images transcribed thereon is discharged onto a delivery tray 22 on the upper surface of the main body of the image forming apparatus 1 by delivery rollers 21 to complete the series of image forming operations. The four full-color images are formed on the recording material P in this manner. The toner and the like remaining in the secondary transferring on the intermediate transferring belt 8 without being transcribed onto the recording material P are removed by the belt cleaning device 13 from the belt 8 for recovery.

The image forming operations described above are for forming the images on one side. Operations for forming images on both sides will be now explained.

The operations for forming images on both sides are substantially the same as those for forming images on one side until the step of transferring a recording material to the fixing device 16. After four full-color images are heated and pressed so as to be fixed on a recording material P by thermal fixing at the fixing nip 31 between the fixing roller 16*a* and the pressure roller 16*b*, the rotation of the delivery rollers 21 is stopped in the state that most of the recording materials P have been discharged onto the delivery tray 22 by the delivery rollers 21. At that time, the delivery rollers 21 have been stopped so that the rear end of the recording material has arrived at a reversible position 42.

Subsequently, the delivery rollers 21 are rotated in a direction reverse to a normal rotating direction in order to feed the recording materials P which have been stopped by the stoppage of the rotation of the delivery rollers 21 into the double-sided pass having double-sided rollers 40 and 41. By rotating the delivery rollers 21 in the reverse direction, the recording material P is caused to arrive at the double-sided rollers 40 in a manner that the rear end of the recording material P which has been reversed becomes the leading end.

Thereafter, the recording material P is transferred to the double-sided rollers 41 by the double-sided rollers 40. In this manner, the recording materials P are sequentially transferred to resist rollers 19 by the double-sided rollers 40 and 41, during which image forming starting signals are produced to transfer the recording material P to the secondary transferring portion 34 by the resist rollers 19 in timing with transferring the leading end of the four color toner images on the intermediate transferring belt 8 to the secondary transferring portion 34 between the secondary transferring opposite roller 10 and the secondary transferring roller 12 in the similar manner to that in image forming on one side as above-described.

After the leading ends of the toner images and of the recording material P have been caused to be coincident with each other at the secondary transferring portion 34 and the toner images have been transcribed, the images on the recording material P are fixed onto the recording material P by the fixing device 16 in the same manner as in forming images on one side, and again the recording material P is transferred by the delivery rollers 21 to be finally discharged onto the delivery tray 22, thereby completing a series of the image forming operations.

Figure 2:
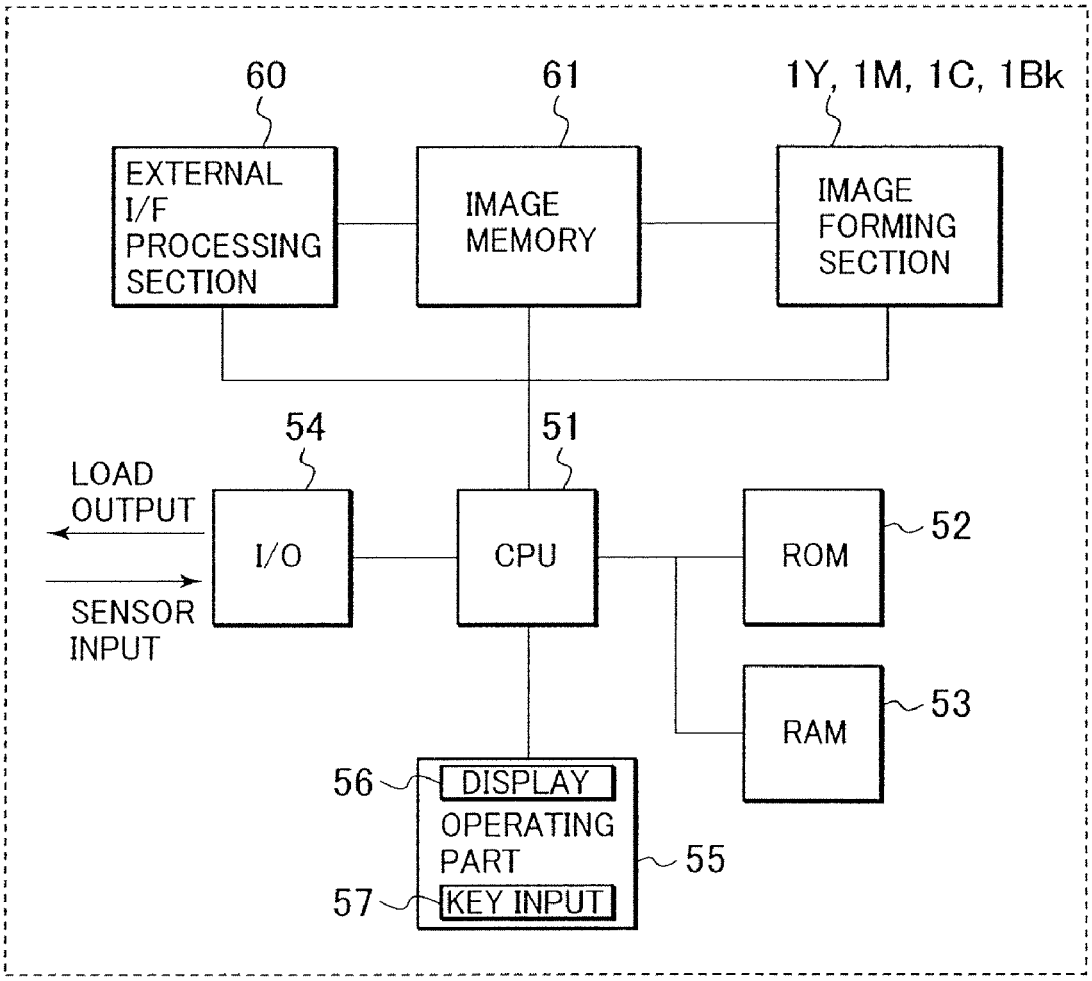
FIG. 2 is a block diagram illustrating a control sequence of the image forming apparatus.

FIG. 2 illustrates a block diagram of a control sequence in the image forming apparatus 1. Connected to a CPU (control means) 51 for basically controlling the image forming apparatus 1 are a ROM 52 onto which control programs have been written, a work RAM 53 for performing processing, and input and output ports 54 by address and data buses. Connected to the input and output ports 54 are input units for various loads such as a motor, clutches and the like for controlling the image forming apparatus 1 and sensors for detecting positions of recording materials P and the like.

The CPU 51 sequentially performs the control of input and output through the input and output ports 54 according to the contents of the ROM 52 to carry out the image forming operations. Moreover, connected to the CPU 51 is an operating part 55 of the image forming apparatus 1 for controlling display means 56 and key input means 57 of the operating part 55. An operator instructs the CPU 51 to switch the image forming operation modes or display through the key input means 57, and the display 56 indicates the state of the image forming apparatus 1 and the setting of its operating mode by the key input means 57. Connected to the CPU 51 are an external I/F processing section 60 for transmitting and receiving image data and processed data from external appliances, such as a PC and the like, an image memory 61 for extracting images or temporarily accumulating images, and image forming units (image forming section) 1Y, 1M 1C and 1Bk for processing line image data transferred from the image memory 61 for exposing them at the exposure device 7. Moreover, the CPU 51 controls a developing bias, amount of exposure and a voltage to be applied to charging members, as will be described later.

Figure 3:
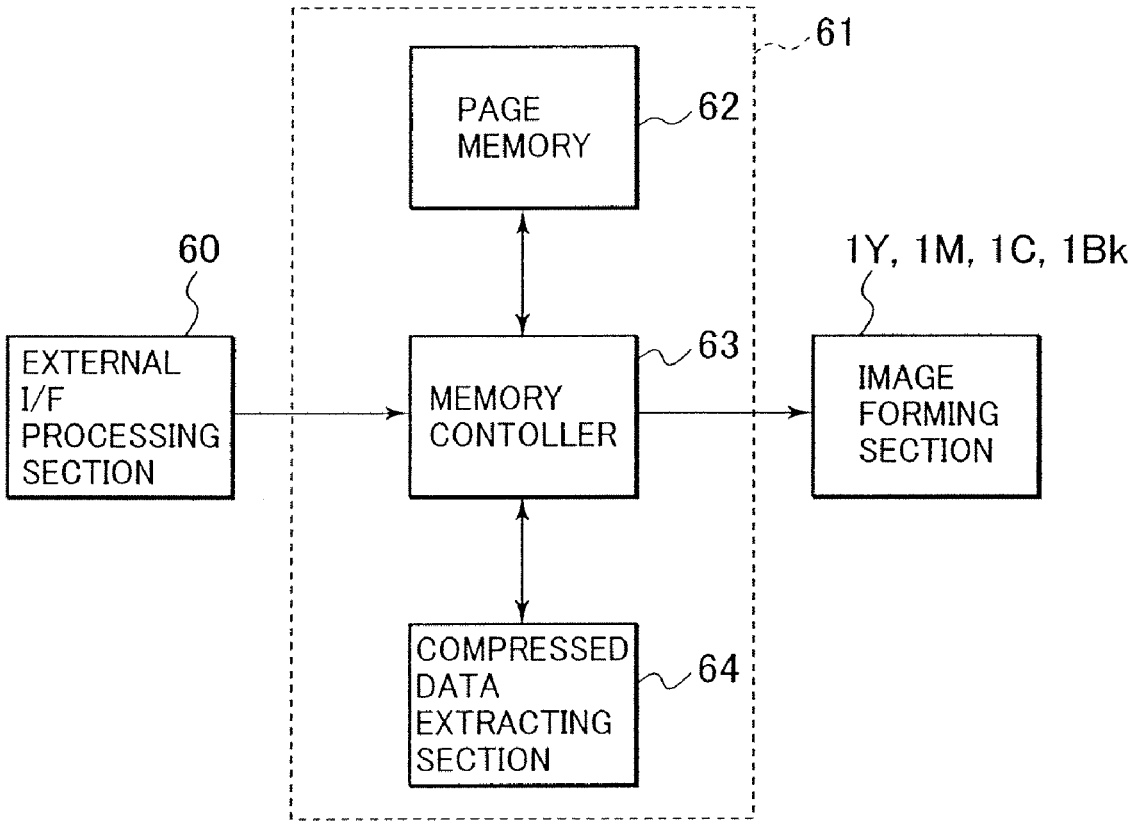
FIG. 3 is a block diagram illustrating the structure of an image memory.

The image memory 61 will be explained in detail with reference to FIG. 3 hereafter. In the image memory 61, accesses for inputting and outputting of images are effected such that image data received through a memory controller 63 from the external I/F processing portion 60 are written to a page memory 62 consisting of memories such as DRAM and images of the image forming units 1Y, 1M, 1C and 1Bk are read out.

The memory controller 63 judges whether image data from an external appliance received from the external I/F processing portion 60 are compressed data. If the data are judged to be compressed data, the data are processed to be expanded or extracted by the use of a compressed data extracting section 64. Thereafter, the extracted data are written to the page memory 62 through the memory controller 63.

The memory controller 63 causes the page memory 62 to produce DRAM refresh signals, and does adjustment of the access to the page memory 62 for writing data from the image I/F processing section 60 and reading out data of the image forming units 1Y, 1M, 1C and 1Bk. Moreover, the memory controller 63 controls addresses for writing and reading data to and from the page memory 62 and controls the directions of reading according to the instruction of the CPU 51.

Figure 4:
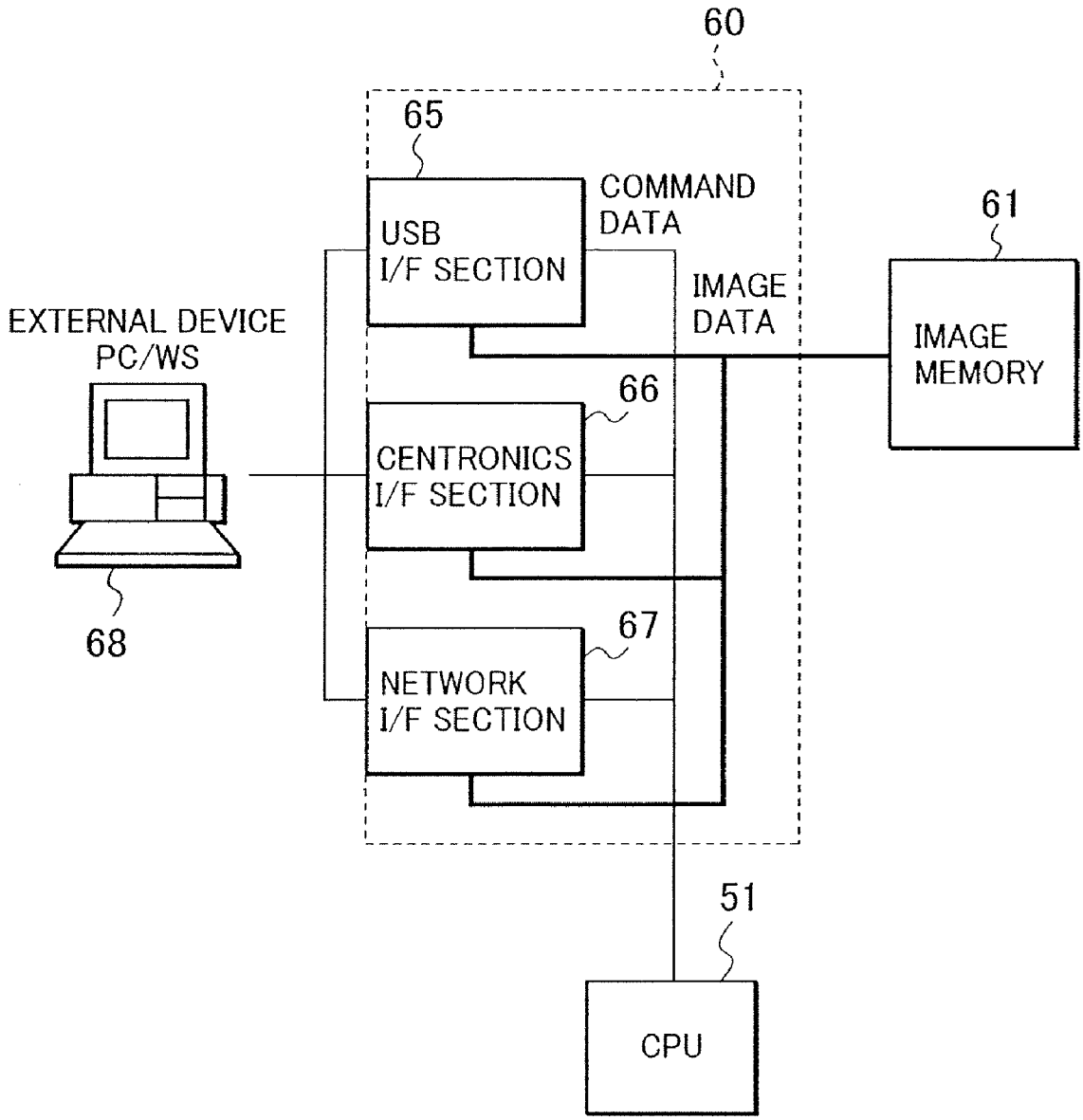
FIG. 4 is a block diagram illustrating the structure of an external I/F processing section.

The structure of the external I/F processing section 60 will now be explained with reference to FIG. 4.

The external I/F processing section 60 receives image data and print command data transmitted from an external device 68 through any one of a USB I/F section 65, centronics I/F section 66 and a network I/F section 67 and transmits information concerning the condition of the image forming apparatus 1 judged by the CPU 51 to the external device 68. In this case, the external device 68 is a computer, workstation or the like.

Print command data received through any one of the USB I/F section 65, centronics I/F section 66 and network I/F section 67 from the external device 68 are processed in the CPU 51 to generate setting and timing for carrying out the printing operations using the image forming units 1Y, 1M, 1C and 1Bk and the input and output ports 54 in FIG. 2.

Image data received from the external device 68 through any one of the USB I/F section 65, centronics I/F section 66 and network I/F section 67 are transmitted to the image memory 61 in response to the timing based on the print command data and processed to form images on the image forming units 1Y, 1M, 1C and 1Bk.

In the aspect of the illustrated embodiment, an electricity removing device is not provided separately for removing the surface charge of the photosensitive drums 2*a*, 2*b*, 2*c* and 2*d*, but the surface charge is extinguished by exposing all peripheral surfaces of the photosensitive drums 2*a*, 2*b*, 2*c* and 2*d* by the use of the exposure device 7. However, a device for extinguishing the electric charge may be provided separately without any objection.

Operations for extinguishing the electric charge will be explained below in detail.

Figure 5:
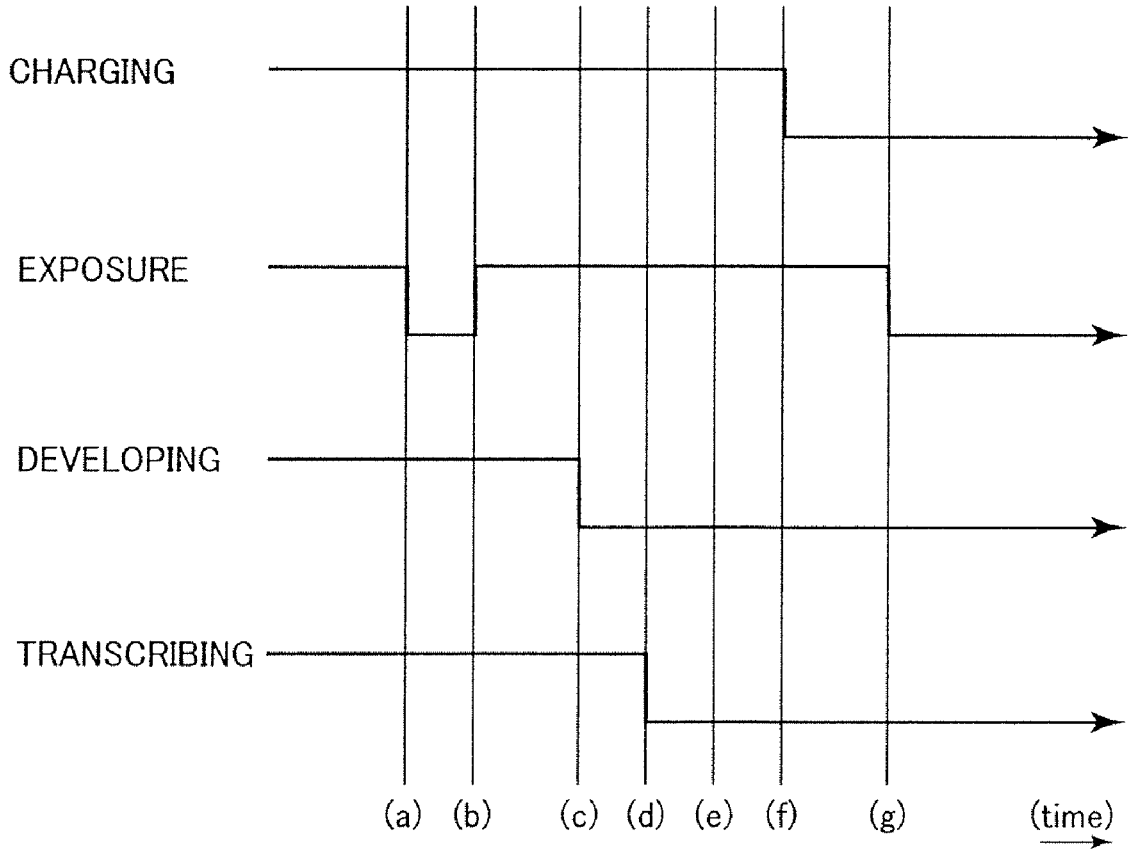
FIG. 5 is a timing chart showing the operation timing of charging, exposing, developing and transferring operations when the image forming is completed.

FIG. 5 is a timing chart illustrating respective timing of operations for charging the photosensitive drum 2*a* among the four drums 2*a*, 2*b*, 2*c* and 2*d* by the primary charging unit 3*a* arranged around the drum 2*a*, exposure by the exposure device 7, developing by the developing device 4*a* and transferring by the transferring roller 5*a*. The following explanation is concerned with the photosensitive drum 2*a*, the operations with the other photosensitive drums 2*b*, 2*c* and 2*d* are the same as those with the drum 2*a*.

The left end of the timing chart shows a state performing the image formation in which, a high voltage is applied to the primary charging unit 3*a*, the developing device 4*a* and the transferring roller 5*a* and the exposure device 7 is emitting light for forming electrostatic latent images in response to image signals.

First, at the timing (a), the exposure of the exposure device 7 for images in regard to their lengths in the transferring direction is completed.

In the case that all the formation of images is finished by this exposure, the exposure device 7 initiates the exposure for extinguishing the electric charge on the photosensitive drum surface at the timing (b) at which a predetermined margin time has elapsed. The "emission of laser" by the exposure device 7 for extinguishing the electric charge on the surface of the photosensitive drum 2*a* is referred to hereafter as "postexposure" in order to distinguish it from the normal exposure in forming images.

The application of a voltage to the developing device 4*a* is stopped in timing (c) with that the region of the photosensitive drum 2*a*, from which the electric charge has been removed, has arrived at the position of the developing device 4*a*. If the application of the voltage to the developing device 4*a* for removing the electric charge is continued even after the timing (c), the region on the photosensitive drum 2*a* from which the electric charge has been removed by the exposure device 7 will be developed by the developing device 4*a* to cause the toner to be deposited on the photosensitive drum 2. On the contrary, if the application of the voltage to the developing device 4*a* is prematurely stopped before the timing (c), carrier will adhere to the photosensitive drum 2*a*, owing to the potential difference between the charged region on the photosensitive drum 2*a* and the developing device 4*a*. Therefore, timing (b) of the start of the postexposure and the timing (c) of the stoppage of the developing voltage must be synchronized with each other.

Figure 6:
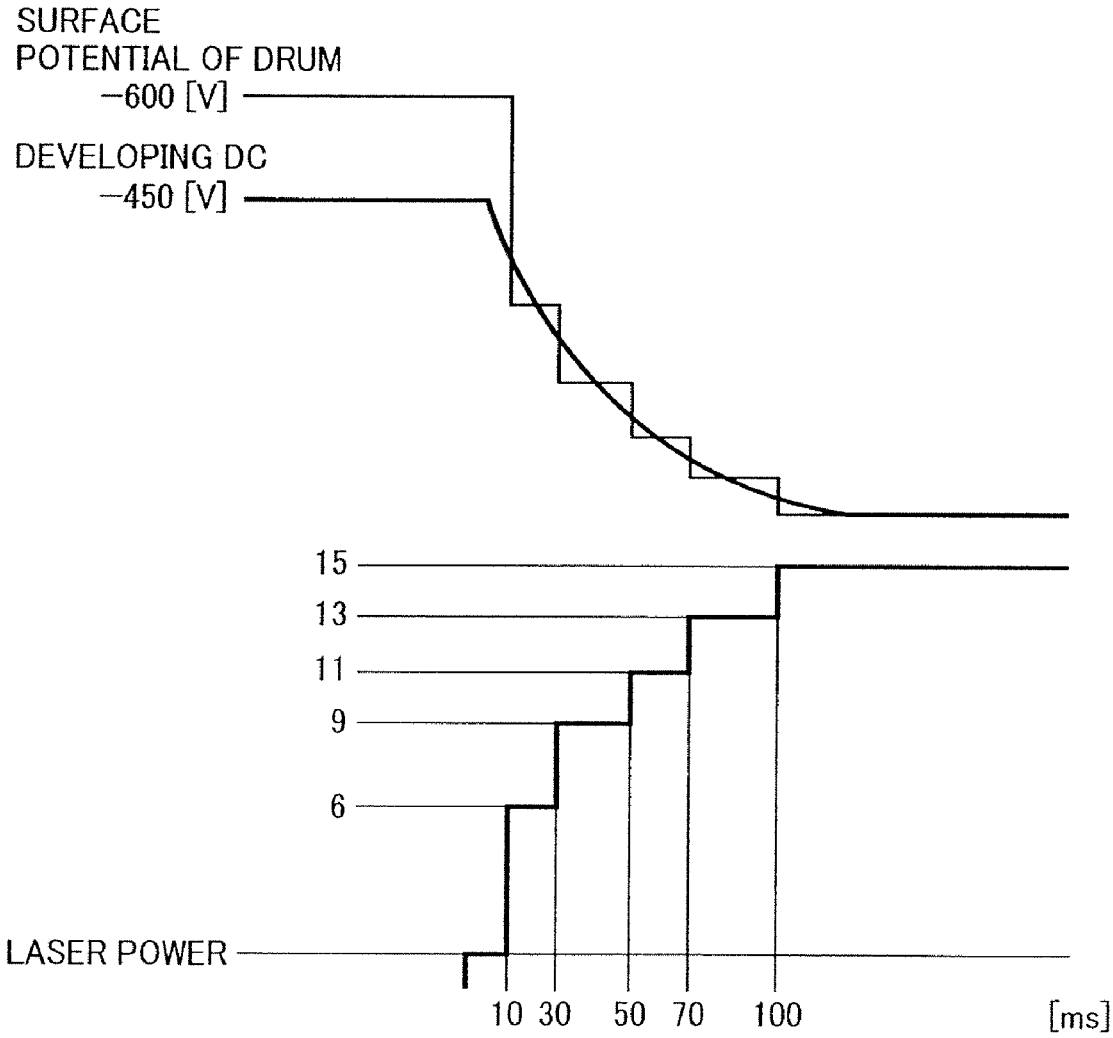
FIG. 6 is a curve illustrating a timing for removing surface electric potential of the photosensitive drum.
Figure 14:
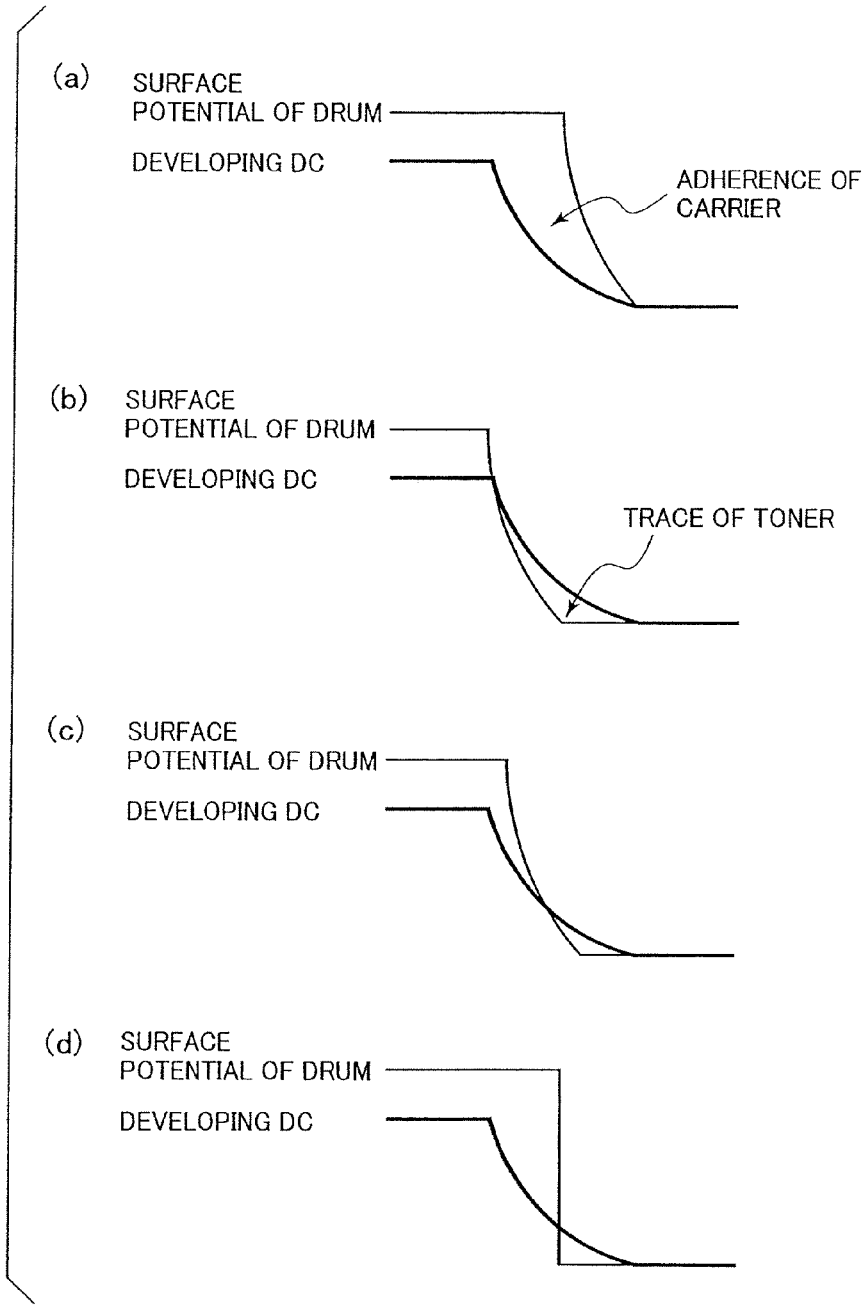
FIG. 14 PRIOR ART
FIG. 14 is a view showing the timing for removing surface electric potential of a photosensitive drum of the prior art.
Figure 15:
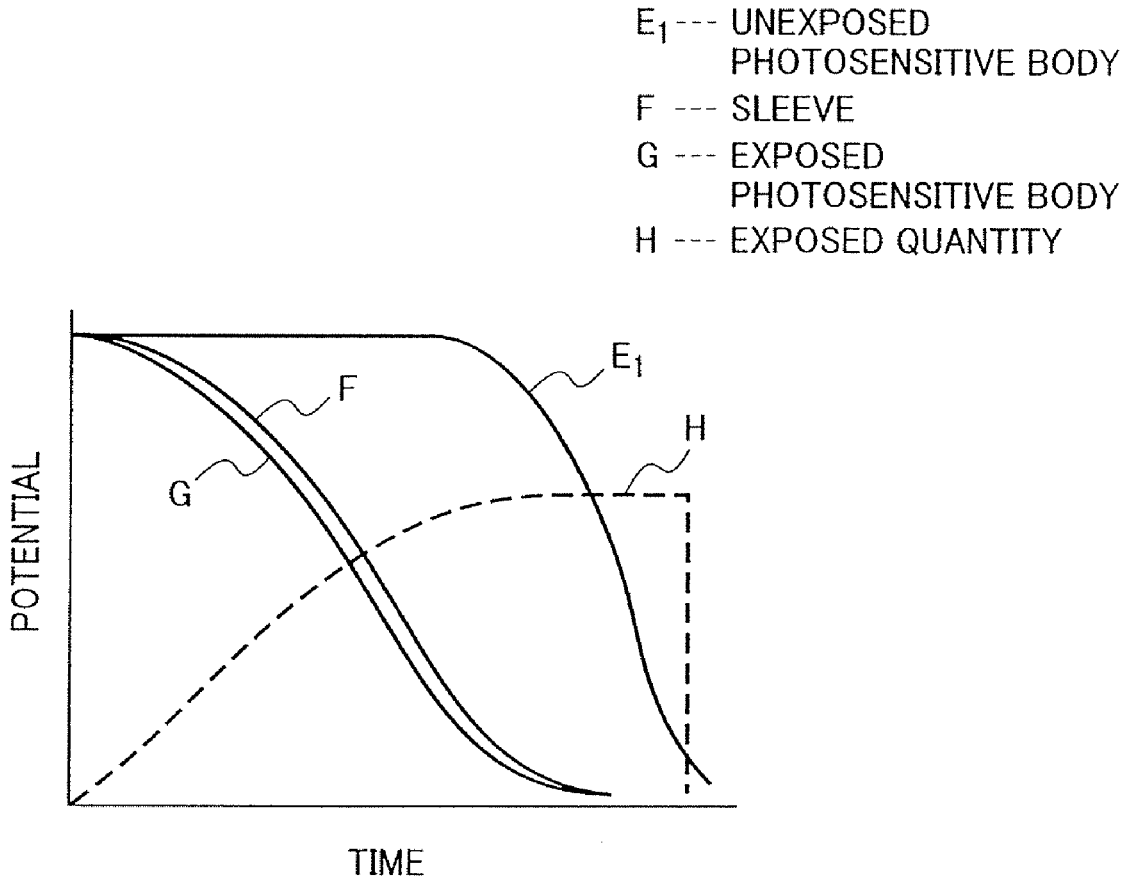
FIG. 15 is a curve illustrating a timing for removing the surface electric potential of a photosensitive drum and developing bias.

The laser power of the exposure device 7 when postexposing will now be explained. If the exposure device 7 is caused to emit the laser at the maximum power at the timing (c), a state similar to that explained concerning FIG. 14(*d*) will occur because the electric potential on the photosensitive drum 2*a* is rapidly lowered. To solve this problem, accordingly, the present invention is characterized by stepwise varying the laser power in a manner conforming to the lowering characteristics of developing bias (developing DC) as shown in FIG. 6.

In an aspect of the invention, the variation in laser power is realized by controlling the exposure device 7 by means of the CPU 51 based on postexposure tables (laser power setting tables: refer to FIG. 7) which are built in the RAM 53 and determined by values of developing biases being applied. Explaining FIG. 6 as an example, as the developing bias which the developing device 4*a* applies is −450 [V], the laser power varying timing table 2 is selected by the postexposure table (b) in FIG. 7. When the developing bias is not more than −350 [V], between −350 [V] and −460 [V], and not less than −460 [V], the postexposure tables (a), (b) and (c) are used, respectively.

The postexposure tables include laser powers which have been set correspondingly to the time from the start of the postexposure. In the case of the laser power varying timing table 2, the laser power is changed over from 0 to 6 at the elapse of 10 minutes from the start of the exposure. At the further elapse of 20 minutes or at the elapse of 30 minutes from the start of the exposure, the laser power is changed over from 6 to 9. Thereafter, the laser power is changed to 9, 11, 13 and 15 according to the table. The laser power 15 is the maximum output of the laser, at which power the photosensitive drum 2*a* is exposed over its full circumference to completely extinguish the charge on the photosensitive drum 2*a*.

By changing the laser power correspondingly to the lowering characteristics of the developing bias, it is possible to diminish to the full extent amounts of the toner attached onto the photosensitive drum 2*a* when removing the developing bias, in comparison with the use of the electricity removing devices of the prior art. However, it is difficult to make the electric potential on the surface of the drum converting to digital by laser irradiation completely coincident with the lowering characteristics of the developing bias converting to analog so that the carrier or toner will be attached to the photosensitive drum 2*a*, although it will be a slight amount. As the carrier attached to the photosensitive drum 2*a* tends to damage the drum, the developing voltage is ceased in timing such that the toner is more likely to attach to the drum than the carrier.

The toner attached onto the photosensitive drum 2*a* at that time is transcribed to the intermediate transferring belt 8 at the position of (e) in FIG. 5 after the movement from the developing device 4*a* to the transferring roller 5*a*. When images of toner failure are transcribed, no voltage is applied to the transferring roller 5*a* so that all toner images on the photosensitive drum 2*a* are not transcribed, as is the case with normal image forming. The images of toner failure on the photosensitive drum 2*a* are partly moved to the intermediate transferring belt 8 in a manner being rubbed against the belt 8 and partly remain on the photosensitive drum 2*a*. Thereafter, the images of the toner failure on the intermediate transferring belt 8 are rotationally moved together with the belt 8 and removed from the belt 8 by the cleaning device 6*a*. The images of the failure toner on the photosensitive drum 2*a* are also removed by the cleaning device 6*a*.

The transferring voltage for the images whose exposure is completed at (a) in FIG. 5 is ceased at the time (d) when the images in regard to their lengths in the transferring direction have been transcribed.

As for the aspect of the illustrated embodiment not having any electricity removing device before the primary charging unit 3*a*, it is required to apply a charge voltage for the region of the photosensitive drum 2*a* to which the transferring voltage is applied. For this end, the application of the primary charging voltage is ceased at the timing (f) when the region (d) of the photosensitive drum 2*a* from which the transferring voltage is ceased has arrived at the position of the primary charging unit 3*a*.

Moreover, the postexposure started at (b) is completed at the point in time (g) at the elapse of time equivalent to one circumferential rotation of the photosensitive drum 2*a*. After the application of a voltage to the primary charging unit 3*a*, the exposure device 7, the developing device 4*a* and the transferring roller 5*a* arranged to face the outer circumferential surface of the photosensitive drum 2*a* is ceased in the manner described above, the driving means (not shown) for rotationally driving the photosensitive drum 2*a* is stopped.

Although the quantity of exposure is changed to change the electric potential on the image bearing member in the illustrated embodiment, the voltage to be applied to charging members may be changed to change the electric potential on the image bearing member.

Embodiment 2

In the embodiment 1, the variation in laser power in the postexposure is achieved by previously providing in the RAM 53 the postexposure tables (laser power setting tables) corresponding to the characteristics of the developing bias.

In this case, however, it would be impossible to accommodate variances in the lowering characteristics of the developing bias owing to an exchange of the developing device due to failure or owing to variances in the characteristics of photosensitive drums with time. In such a case, it may be envisioned to rewrite the postexposure tables by a service man or a technician in a service center when the developing device has been exchanged. However, it is desirable that the image forming apparatus is able to automatically carry out the adjustment by itself.

The control (adjusting mode) for automatically producing postexposure tables when postexposing will be explained hereafter. However, the basic structure of the applied image forming apparatus is substantially similar to that in the embodiment 1, and it will not be described in further detail.

Figure 8:
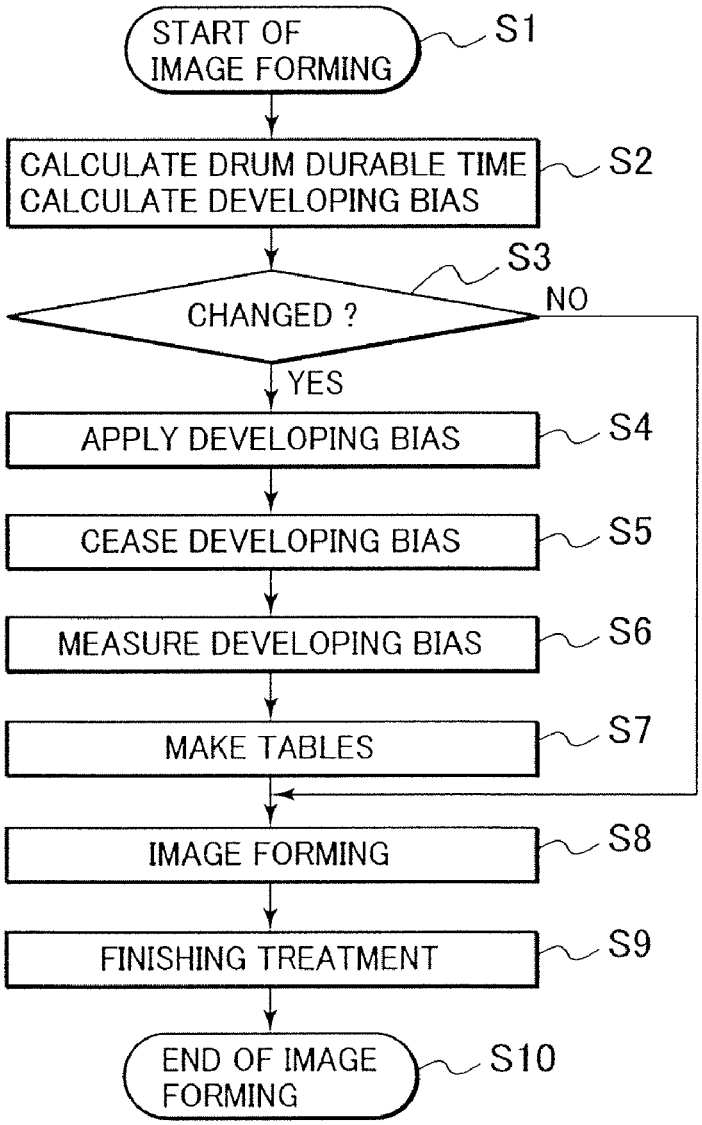
FIG. 8 is a flowchart for automatically making laser power setting tables when postexposing.

FIG. 8 illustrates a flowchart from the start of image forming, and making postexposure tables for postexposing and carrying out the postexposure using the tables.

First, the image forming is started (step S1, simply referred to hereafter as "S1") and the value of developing bias to be applied is determined in response to durable time of the photosensitive drum 2*a* according to the postexposure table in FIG. 9 (S2). In the case that the value of developing bias is varied from that last used (case of "yes" of S3), it will be judged that there is a need to make a postexposure table for the postexposure because the lowering characteristics of developing bias have been changed due to the variance of the developing bias value.

In making the postexposure table, first, the developing bias is impressed (S4). After a lapse of a predetermined time, the application of developing bias is ceased (S5), and at the same time, measurement of the developing bias in the developing device is started (S6). In the aspect of the present embodiment of the invention, potential sensors are provided in the developing device for measuring the developing bias in the developing device. In this embodiment, since approximately 10 minutes is needed for changing the laser power, the measurement of lowering characteristics of developing bias is carried out as a unit of 10 minutes.

Figure 10:
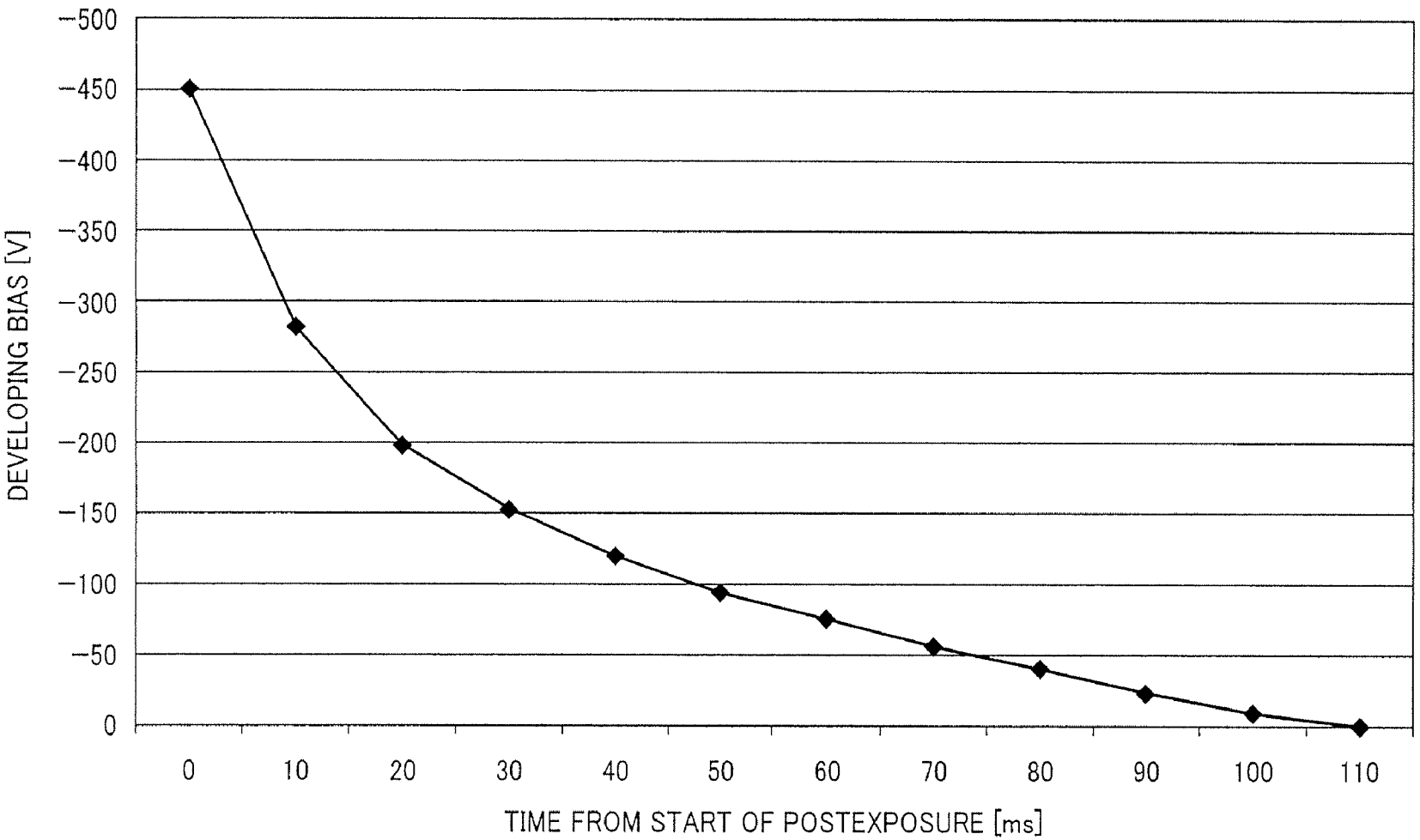
FIG. 10 is a curve illustrating the relation between time from start of postexposure and developing bias (results of measuring the lowering characteristics of developing bias)

FIG. 10 illustrates the results of measuring the lowering characteristics of developing bias with an interval of 10 minutes. FIG. 11 shows postexposure tables obtained from the results of these measurements (S7 in FIG. 8). The time from the ceasing of the application of the developing bias in FIG. 11 and the developing bias values at that time are obtained from the graph in FIG. 10. It is assumed that the surface potential at the surface of the photosensitive drum is -600 [V], the difference therebetween can be obtained as in FIG. 11. If the electric charge removing effect, the same as this value, is obtained by removing the electric charge by the use of the exposure device, the potential difference between the surface of the drum and interior of the developing device becomes zero so that removal of the electric charge is effected in the most suitable state without toner and carriers being attached to the surface of the drum.

In this case, the exposure device is so designed that when the laser is emitted at the maximum power (set value 15), electric potential of −600 [V] at the surface of the drum can be removed. Accordingly, there is an electricity removing effect that electric potential of −40 [V] can be removed at the stage of set value 1. In order to avoid carrier from attaching to the surface of the drum as much as possible, moreover, it is desired that the electric potential at the surface of the drum is lower than that in the developing device.

For example, it is required to remove a potential more than 318 [V] from the surface of the drum at the point in time of 10 minutes from ceasing of the developing bias. At that time, the laser power set value 8 is obtained which is able to remove a potential of 320 [V]. Thereafter, laser power set values and set timing until the developing bias reaches 0 [V] can be obtained in the same manner described above (S7 in FIG. 8).

After the postexposure tables have been obtained in the manner described above, the normal image forming operations are effected (S8) and when the image forming operations have been completed, a finishing treatment is performed (S9). Controlling for removing the potential at the surface of the drum is carried out with the similar timing to that in the embodiment 1 using the postexposure tables in postexposing made in S7 described above. When the finishing treatment has been completed, the image forming apparatus is stopped (S10).

According to an aspect of this embodiment of the invention, the electric charge can be effectively removed from the surface of the photosensitive drums by stepwise changing a quantity of exposure by the use of tables automatically made by the image forming apparatus itself, even if the lowering characteristics of exposure bias are changed owing to replacement of developing device due to failure or variance of the characteristics of the photosensitive drum due to the effects of time.

Embodiment 3

In the embodiments described above, electric potentials of the developing members and image bearing members are prevented from increasing by changing the quantity of exposure correspondingly to the attenuating and lowering characteristics of electric potential of the developing device. In the present embodiment, a case will be explained that after turning off the application of the voltage to the charging roller, the electric potential on the image bearing member attenuates at lower rates. In this case, the effects of the present invention can also be obtained by the method for controlling the potential difference between the attenuating of the electric potential on the image bearing member and the voltage applied to the developing member to be a predetermined value, with a plurality of the voltages previously provided to be applied to the developing members.

Figure 12:
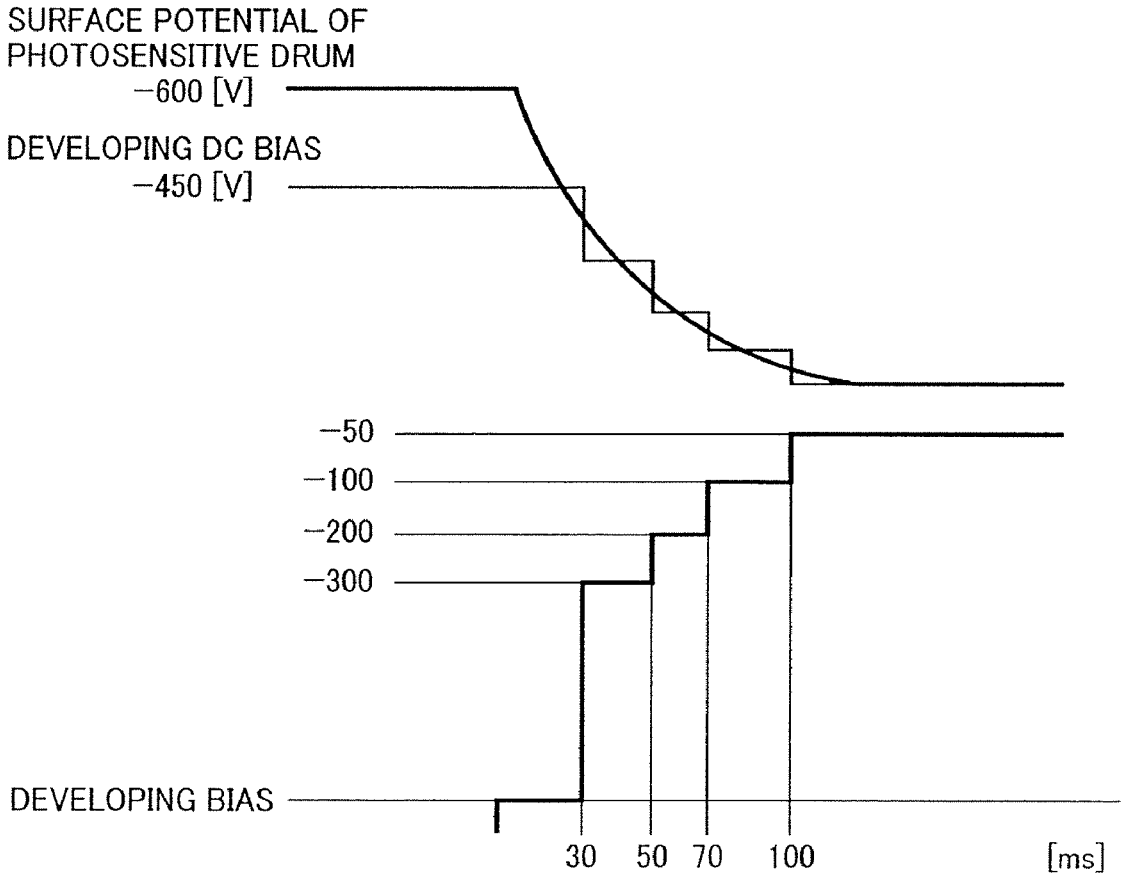
FIG. 12 is a curve illustrating a timing for switching the developing bias in the embodiment 3.
Figure 13:
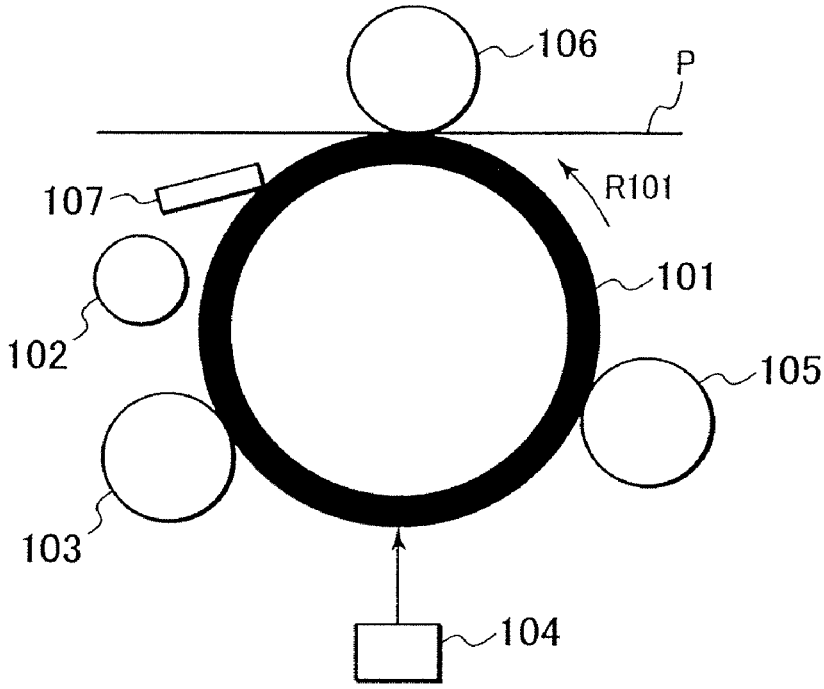
FIG. 13 PRIOR ART
FIG. 13 is a view illustrating an image forming unit of the image forming apparatus of the prior art.

FIG. 12 illustrates an example of the present embodiment. When forming images, the electric potential of the photosensitive drum is -600 V and the developing bias is -450 V and after the image forming operations have been completed and charge bias to be applied to the charging member has been turned off, counting is started and when the count value becomes that shown in the drawing, the developing bias is stepwise changed over.

Even with the structure of the present embodiment in which the object whose electric potential attenuates is different from that in the previous embodiments, the same effects as those in the above-described embodiments can be obtained.

In the image forming apparatus having a plurality of electric potentials to be targeted on the photosensitive drum and capable of switching over the voltages to be applied to the charging member in response to a target potential, following controls are possible as well. In the case that the voltages applied to the charging member are different owing to different target potentials, a structure similar to that in the embodiment 2 may be used in which after the charging bias has been turned off, the developing bias is stepwise changed with different intervals.

Although the attenuation of electric potential is in a curved line in the embodiments described above, the same effects can be obtained by carrying out the same controlling even with electric potential attenuating in a straight line.

According to the invention it is possible with a simple structure to mitigate the adherence of developer to image bearing member owing to electrical contributing factor of the lowing characteristics with attenuation as above-described.

While the invention has been particularly described with reference to preferred embodiments thereof, it will be understood that all modifications and variations are possible within the spirit and scope of the invention without being limited to the embodiments described above.

This application claims priority from Japanese Patent Application No. 2004-167708 filed Jun. 4, 2004, which is hereby incorporated by reference herein.

What is claimed is:

1. An image forming apparatus comprising:

an image bearing member;

a charging member for charging said image bearing member by applying a charging voltage;

an electrostatic latent image forming device configured to form an electrostatic latent image on said image bearing member charged by said charging member;

a developing member for developing the electrostatic latent image formed on said image bearing member by applying a developing voltage; and a developing voltage control unit configured to switch the developing voltage to be applied to said developing member in a plurality of steps in such an amount that the developing voltage to be applied to said developing member decreases after a predetermined period of time has passed since the charging voltage to be applied to said charging member is turned off.

2. The image forming apparatus according to claim 1, wherein said developing voltage control unit switches the developing voltage to be applied to said developing member in a plurality of steps such that an amount of the developing voltage to be switched is smaller in a late phase of the plurality of steps than in an early phase of the plurality of steps.

3. The image forming apparatus according to claim 1, wherein said developing voltage control unit switches the developing voltage to be applied to said developing member in a plurality of steps such that an interval between processes of switching the developing voltage gets longer in a late phase of the plurality of steps than in an early phase of the plurality of steps.

* * * * *